United States Patent [19]

Fey et al.

[11] Patent Number: 4,859,072

[45] Date of Patent: Aug. 22, 1989

[54] DEVICE FOR THE CONTINUOUS PRODUCTION OF A LIQUID MIXTURE OF SOLIDS AND LIQUIDS

[75] Inventors: Hans Fey, Hasselroth; Manfred Czapiewski, Offenbach, both of Fed. Rep. of Germany

[73] Assignee: Matra-Werke GmbH, Frankfurt am Main, Fed. Rep. of Germany

[21] Appl. No.: 237,957

[22] Filed: Aug. 30, 1988

[30] Foreign Application Priority Data

Sep. 3, 1987 [DE] Fed. Rep. of Germany ..... 3729527

[51] Int. Cl.[4] ..... B01F 15/02

[52] U.S. Cl. ..... 366/165; 366/156; 366/167

[58] Field of Search ..... 366/165, 167, 173, 177, 366/182, 136, 137, 33, 34, 35, 155, 156, 159, 150, 163

[56] References Cited

U.S. PATENT DOCUMENTS

| | | | |
|---|---|---|---|
| 4,184,771 | 1/1980 | Day | 366/165 |
| 4,493,249 | 1/1985 | Stover | 366/163 |
| 4,778,280 | 10/1988 | Brazelton | 366/150 |

FOREIGN PATENT DOCUMENTS

| | | |
|---|---|---|
| 8630501 | 5/1988 | Fed. Rep. of Germany . |
| 8630502 | 6/1988 | Fed. Rep. of Germany . |

*Primary Examiner*—Robert W. Jenkins

*Attorney, Agent, or Firm*—Thomas R. Shaffer

[57] ABSTRACT

A device for the continuous production of a liquid mixture of solids and liquids has a rotation-symmetric space with approximately vertical rotation axis for the formation of a rotational flow. In order to obtain a simple, but reliably operating mixing device that furnishes a predictable mixing result, even if a very intense or considerably weaker stream is to be periodically present, it is proposed to design the rotation-symmetric space as an annular space (13) with an internal overflow edge (14) and to provide a funnel-shaped collecting basin (18) under the overflow edge (14) and to provide the discharge openings of the dosing devices (52, 53) for the substances to be mixed above the overflow edge (14). The liquid mixture is to selectively pass to a mixing vessel (28) or directly to a discharge pump (27) at the outlet of the collecting basin (18).

11 Claims, 1 Drawing Sheet

DEVICE FOR THE CONTINUOUS PRODUCTION OF A LIQUID MIXTURE OF SOLIDS AND LIQUIDS

BACKGROUND OF THE INVENTION

1. Field of the Invention

The present invention relates to a device for the continuous production of a liquid mixture of solids and liquids. More specifically it relates to such a device having a rotation-symmetric space therein with an at least approximate vertical rotation axis, in which a rotational flow is induced.

2. Description of the Prior Art

Granular chloride of lime is primarily provided as the solid and water, solvents and/or emulsifiers are primarily provided as the liquid components, in which case the device is to produce as such the stream of a water-chemical mixture required for decontaminating strips of ground or equipment. Various difficulties must be overcome here. One difficulty consists in mixing the granular or lumpy solid, chloride of lime in particular, uniformly with the stream of water, where a certain residence time is required for dissolution of the solid in the water.

A mixing device is known from the DE-OS No. 34 41 529, in which water is introduced into a rotation-symmetric container with a vertical axis from below and is set into a rotational flow by a disk rotating around a coaxial axis. A liquid stream in which the solid is dissolved is fed into this rotating water coaxially from above through a second pipeline, whereby it is expected that this stream coaxially flowing in from above mixes with the stream flowing in from the bottom, where it is also provided that additional liquid components can be added through pipes connected on the side. The rotation-symmetric vessel is limited upward by an overflow edge. The excess stream passes over this overflow edge into a collecting vessel that surrounds the rotational container on the outside and is discharged into its lower zone. The contact surface of the flow, which is to rotate, with the wall of the rotational vessel is considerably larger than the contact surface with the wall of the rotating disk and the flows that can form inside of the rotational vessel and can be used for the mixing are quite unpredictable.

SUMMARY OF THE INVENTION

The present invention thus proposes a simple but reliably operating device, through which a granular, water-soluble solid can be continuously mixed into a liquid stream with flawless and predictable mixing results even if a very strong or considerably weaker stream is periodically desired.

This task is accomplished according to the invention in that the rotation-symmetric space is an annular space that has an over flow edge on the inner side, where a funnel-shaped collecting basin is located below the overflow edge and the discharge openings of the dosing devices for the solid and liquid components are located above the overflow edge.

Due to the rotational flow in the annular space, a higher pressure will prevail in its outer zone than in the inner zone. Consequently, the inner overflow edge must be lower than the outer edge so that the rotational flow can get into the funnel-shaped collecting basin. The solid and the liquid components come in from above onto the surface of the rotating water flow. Due to the rotational flow, a sufficiently long path is available for mixing the components in the water stream. The entire annular space is preferably covered by a lid that covers the overflow edge and from which a cylindrical part projects down inward so that a gap is formed between this part that projects down inward and the wall whose upper edge forms the overflow edge, in which case laterally splashed solid particles cannot get into the water stream due to the overhanging cover wall. In any case, it is assured in this manner that a rotational flow is formed on this inner wall, on the upper edge of which the overflow edge is formed, and in the funnel located under it, and a certain stream of granular solid and liquid components is fed into this rotational flow from above by means of the dosing devices. The liquid mixture can be drawn off at the lowest point of the funnel. If there is the danger that undissolved solid particles will accumulate at this lowest point and plug the discharge line, the discharge line can also be connected, preferable tangentially, above the lowest point of the funnel. The connection can be effected here in the direction or against the direction flow; in the latter case an intense turbulence and thus mixing is again achieved prior to entrance into the drain pipe.

Particularly advantageous implementations are indicated described below.

In one embodiment, one feed line for a liquid flow under pressure empties tangentially into the annular space. This implementation form makes it possible to achieve the rotational flow in the annular container in a simple manner, namely because the water feed line or lines empty tangentially into the annular space, where it can be advantageous if they empty from the bottom or from the surrounding side wall without projecting into the annular space, so that the flow enters tangentially with no projection of the pipe parts into the vessel. It is also conceivable to feed liquid components in the annular space.

The water flow is expediently fed to the annular vessel by a pump that creates a pressure. It is particularly advantageous here if the delivery line of the pump is divided into two branch lines, both of which are connected through feed lines with the annular space. A shutoff valve and a flow-regulating valve are located in series in each branch line, in which case the two flow-regulating valves are designed for flows of different size. It is also possible to regulate the delivery stream of the pump via its r.p.m. or by a single flow-regulating valve in the delivery line. In any case, it is possible by one of these methods to determine which water flow, i.e., which amount of water per unit of time, is fed to the annular space and thus determine the amount of solid and liquid components that must be introduced by the dosing devices into the rotational flow in order to obtain the desired mixing ratio. A smaller stream of liquid mixture can thus be produced, as required for example for equipment decontamination, or a larger stream of liquid mixture, as required for the decontamination of a broad strip of land.

It is advantageous to provide a switchable multi-way valve in the delivery line of the pump whose suction line is connected to the outlet of the funnel and which serves to convey the liquid mixture further along. This multi-way valve connects the pump with a mixing vessel in one switching position and the delivery line of the pump with the suction line of the discharge pump in another switching position. It is thus possible if the mixing was insufficient due to the feeding in of a great many components in large quantities to selectively achieve an additional mixing with the aid of the mixing vessel. In another case, i.e., with an adequate mixing of the components, the liquid mixture can go directly to the discharge pump and from there applied to the object of decontamination.

An intensive mixing of the individual components is obtained with the implementation wherein the mixing vessel consists of a number of chambers that are connected with each other in series, and each chamber has a pump whose suction line is located inside of the chamber close to the bottom and whose delivery line is divided into two branch lines, one of which empties into the subsequent chamber above the maximum level and the other is returned into the suction chamber near its bottom, and where one of the branch lines of the delivery line of pump of the last chamber of the in-series chambers of the mixing vessel is connected with the suction line of the discharge pump. The pumps of the individual chambers can be designed so that their delivery volume considerably exceeds the amount of liquid mixture continuously required, such that a dividing of the stream is facilitated and the considerably larger amount of liquid mixture is pumped over into the chamber pertaining to the pump, while only the amount of liquid mixture continuously required is conveyed to the next chamber and finally reaches the discharge pump after passing the last pump.

Various implementations of the present invention facilitate various operating states of the mixing device by the closing off of lines. In one implementation, a multi-way valve is located in the second branch line of the delivery line of the pump of the last chamber of the in-series chambers of the mixing vessel and it interrupts the connection of the discharge pump to the suction line in a certain switching position. In another implementation, the outlet of the funnel-shaped collecting basin is connected through a line with the suction line of the discharge pump and a multi-way valve is located in this connection line that interrupts the connection of the discharge pump to the suction line in a certain switching position. In yet another such implementation, the delivery line of the discharge pump has a multi-way valve that short-circuits the delivery line of the discharge pump with its suction line in a certain switching position.

The individual drives can be regulated and switched in or out individually by an implementation wherein the drive of all the pumps with the exception of the discharge pump and the drive of the dosing devices for the solid and liquid components are each an electric motor.

It is expedient according to yet another embodiment of the invention to connect the actuating element of the multi-way valve located in the delivery line of the discharge pump with electric switches, by which the electric motors of all the other pumps can be switched off in the position of the multi-way valve in which the delivery line and suction line in the discharge pump are short-circuited, in order to prevent the feeding of new material. In this embodiment the actuating element of the multi-way valve located in the delivery line of the discharge pump is connected with an electric switching member, by which the electric motors of the pumps with the exception of the discharge pump, and the electric motors of the dosing devices of the solid and liquid components are switched into the one switching position.

In another implementation form of the invention it is also possible to install a flowmeter in the delivery line of the pump for supplying water to the annular space between it and the latter and regulate the drive motors of the dosing devices and the pump at the outlet of the funnel as a function of its measurement signal. More specifically, a flow-meter is located in the feed line to the annular space and its output signal controls the speed of the electric motors of the dosing devices for the solid and liquid components and the pump between the funnel-shaped collecting basin and the chambered mixing vessel.

Other implementation forms of the present invention facilitate a switching on and off of the pumps as needed. For example, in one form, lower switches are provided in the chambers of the mixing vessel and they switch on the electric motors of the pumps when the minimum liquid level is reached, and that an upper switch common to all the chambers is provided in the first chamber and it switches off the electric motor of the pump between the funnel-shaped collecting basin and the chambered mixing vessel when the maximum liquid level is exceeded. In another such form, switches are located in the funnel-shaped collecting vessel with a vertical spacing from each other and they switch the electric motors of the feeds in or out as a function of the liquid level.

The invention is further elucidated below on the basis of the following schematic examples.

DETAILED DESCRIPTION OF THE PREFERRED EMBODIMENTS

Figure 1:
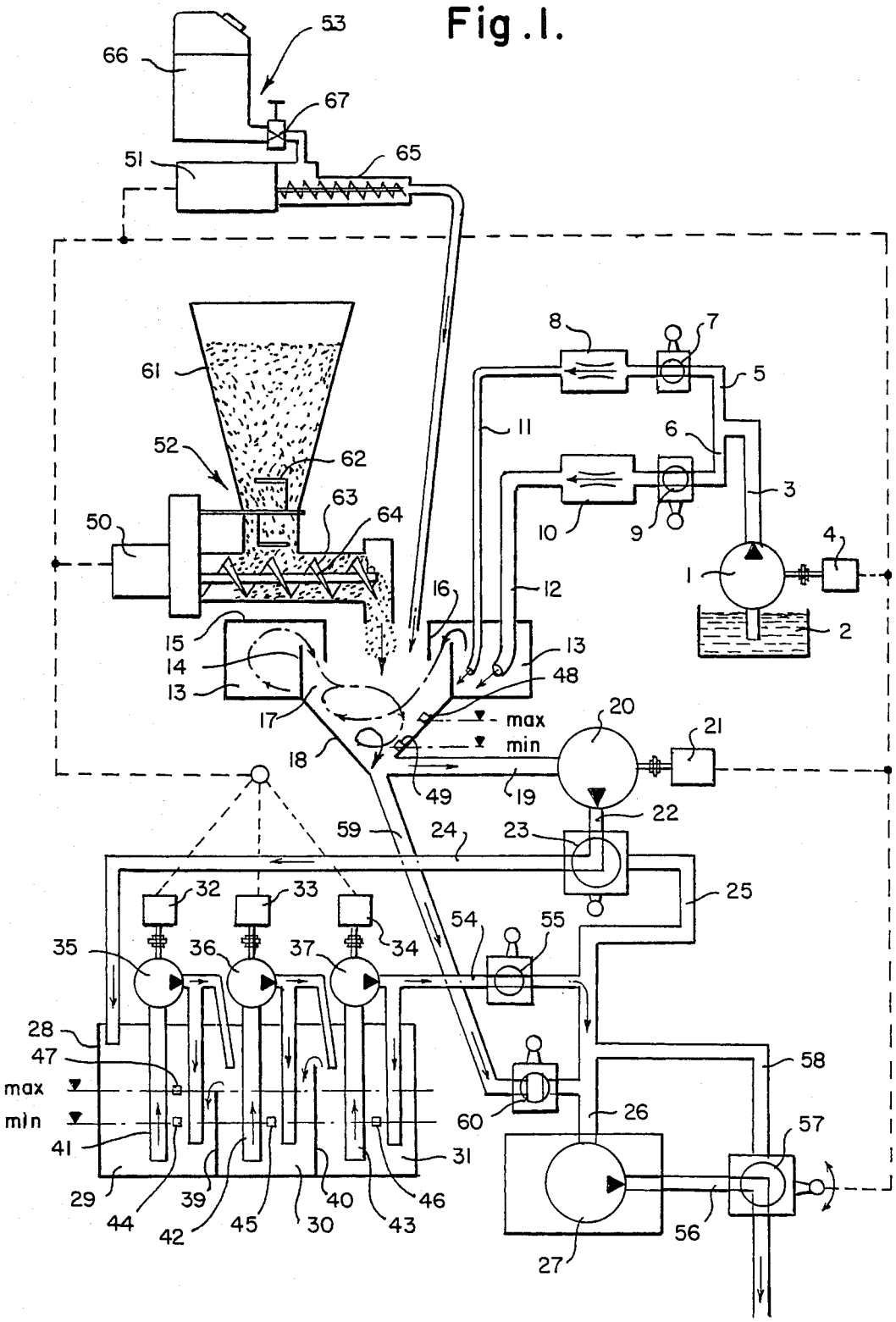
FIG. 1 is a schematic view of the mixing device of the present invention.

Pump 1 draws from the water tank 2 and delivers into the delivery line 3. Pump 1 is driven by the electric motor 4. The delivery line 3 is branched into the two lines 5 and 6, where a shutoff valve 7 and a flow-regulating valve 8 are located one after the other in branch line 5. A shutoff valve 9 and a flow-regulating valve 10 are analogously located in branch line 6. A line 11 leads from the flow-regulating valve 8 and a line 12 leads from the flow-regulating valve 10 into the toroidal annular space 13, which has an inner overflow edge 14. The annular space 13 is covered by a lid 15, the overhang 16 of which covers the overflow edge 14. The inner wall 17 of the annular space 13 is cylindrical. A funnel 18 connects to it downward and, at its lowest point, a line 19 is connected and leads to a second pump 20 that is driven by an electric motor 21 and feeds into a delivery line 22. A multi-way valve 23 is located in this delivery line 22 and a line 24 and a second line 25 go out from this valve 23, where the second line 25 is connected to the suction line 26 of a discharge pump 27.

The line 24 leads into a first chamber 29 of a mixing vessel 28, which in this example consists of three consecutively connected chambers 29, 30 and 31. The pumps 35, 36, 37 driven by the electric motors 32, 33, 34 are assigned to the chambers. The chambers are separated from each other by partitions 39, 40 of different height. The height of the partitions 39, 40 increases with each consecutive chamber, beginning with the first chamber 29, such that the partition between the last and next-to-last chambers is the highest. The suction lines 41, 42, 43 belonging to the pumps 35, 36, 37 are arranged so that the liquid mixture is drawn in at the bottom of the chamber. The delivery line of each pump is divided in two. One line with a larger cross section runs back into the chamber to the bottom of it, where the opening of the suction line is located. A second line with a smaller cross section empties into the next chamber in the series, above the maximum possible liquid level there. Only the amount of liquid mixture continuously required is thus conveyed from chamber to chamber. The overwhelming proportion remains in continuous circulation due to the division of the stream because an overflow back to the first chamber 29 always occurs due to the different heights of the chamber partitions. An intensive mixing with an adequate residence and dissolving time is thus achieved.

Switches 44, 45, 46 located in the chambers control the minimum level of the liquid mixture of each chamber lying above the suction openings of the suction line 41, 42, 43. If the minimum level is reached in a chamber, the pump pertaining the previous chamber is switched on. Another switch 47 controls the maximum liquid level in the mixing vessel 28. This switch 47 is thus in the first chamber 29. It switches off when the maximum state of the pump 20 is reached.

Switches 48, 49 are provided in the funnel 18 for controlling the liquid level; they switch the electric motors 4, 50, 51 of the water pump 1, a solids dosing device 52 and a dosing device 53 of the liquid components on and off when a certain level is exceeded or dropped below. Of course, a number of dosing devices can also be provided for the solid and liquid components.

The second line with a smaller cross section of the delivery line of the pump 37 of the last chamber 31 is connected through the line 54 with the suction line 26 of the discharge pump 27. The line 54 can also be shut off by means of a switchable multi-way valve 55. The discharge pump 27, preferably a combustion engine-driven portable power pump, is connected through a delivery line 56, in which a switchable multi-way valve 57 is located, with the discharge devices, e.g., spraying equipment, (not shown), in the case of a definite switching position of the multi-way valve 57. In another switching position of the multi-way valve 57, the delivery line 56 and the suction line 26 are short-circuited over a return line 58; the electric motors 4, 21, 32, 33, 34 50, 51 of the pumps 1, 20, 35, 36, 37 and the dosing devices 52, 53 are switched off in this switching position.

Another line 59 is connected to the outlet of the funnel 18; it is provided with a switchable multi-way valve 60 in one switching position of which the line 59 is shut off. The line 59 is in direct connection with the suction line 26 of the discharge pump 27.

The solids dosing device 52 consists essentially of a charging funnel 61, which is filed with the solid to be mixed in, in which case the solid is kept in motion with a rotor 62, and metering device 63 in the lower zone of the charging funnel 61, whose discharge worm 64 is driven by the adjustable electric motor 50.

The dosing device 53 of the liquid components consists of a delivery device 65 that is driven by the adjustable electric motor 51 and into which the liquid component to be mixed in flow from a tank 66 through a shutoff valve 67. Two tanks 66 are expediently situated vertically one behind the other, where a shutoff valve 67 is provided at each of the tanks 66 and one tank 66 receives the solvents and the other receives emulsifiers or a premixed mixture of solvent and emulsifier is contained in both.

An electrical switching element that is coupled with a voltage source and is connected with the actuating lever of the multi-way valve 57 is applied to the multi-way valve 57 (it is not shown in the drawing). Electrical leads are placed between the switching element and the electric motors of the mixing device.

The mode of operation of the mixing device is as follows: the pump 1 draws water from the water tank 2 and conveys it through the delivery line 3 into the branch lines 5 and 6. The two flow-regulating valves 8 and 10 are adjusted to flows of different size, with flow-regulating valve 8 preferably being set to a small flow, as required for equipment decontamination, and the flow-regulating valve 10 is set to a large flow, as required for land decontamination. If the shutoff valve 9 is closed and the shutoff valve 7 opened, only a small stream flows into the annular space 13 of the mixing device, while if the shutoff valve 7 is closed and the shutoff valve 9 is open, a considerably larger stream flows, as required for land decontamination. In one implementation example the flow-regulating valve 8 is set to a throughflow of 21 l/min and the flow-regulating valve 10 is set to a throughflow of 180 l/min.

Through the tangential influx of the water stream from the line 11 or 12 or the water streams from the lines 11 and 12 into the annular space 13 a rotating flow is created in the latter. With adequate filling of the annular space 13 and subsequent refilling the water flows over the overflow edge 14 into the space inside of the wall 17 and the funnel 18, where it retains its rotational flow. A specific amount of chloride of lime per unit of time now drops from above from the solids dosing device 52 into this rotating water flow. The chloride of lime thus strikes the free surface of the circulating water flowing in the funnel 18 and is entrained by the latter and thus dissolves.

A certain amount of solvent and/or emulsifier also comes from above from the dosing device 53 of the liquid components per unit of time into the rotating water stream and mixes with it and the chloride of lime. It can be assured by means of familiar apparatuses such as sieves, centrifugal separators or the like that no lumps of chloride of lime are entrained through the suction line 19 to the second pump 20.

With an appropriate setting of the multi-way valve 23 in the delivery line 22, the water-chemical mixture is fed through the pump 20 to the mixing vessel 28, where it is rotated in the manner described. From there, the liquid mixture passes through the feed line 54 equipped with a shutoff multi-way valve 55 and through the suction line 26 to the discharge pump 27, which is connected with the spray equipment for decontamination.

In the case of necessary interruptions in the spraying process, with which the mixed stream produced in the device is sprayed, the multi-way valve 57 in the delivery line 56 of the discharge pump 27 is switched into the by-pass position so that the discharge pump 27 pumps the remaining amount in the by-pass. In this switching state of the multi-way valve 57 the electrical switching element connected with the actuating lever of the multi-way valve 57 handles the switching off of all the electric motors. The switching on or reswitching on is effected entirely by the multi-way valve 57 or the electrical switching element connected to it.

The electrical motors can be individually switched on and off by the arbitrarily actuatable additional switches.

Different switching states are thus possible:

In the first switching state all the electric motors are running. A mixture of water, solids and liquid components is prepared in the manner described, since the multi-way valve 23 is switched, as shown in the drawing, so that the liquid mixture flows through the mixing vessel 28.

In the second switching state only a mixture of the solids from the charging funnel 61 and water is to be produced. In this case the electric motors 4 and 21 of the pumps 1 and 20 and the motor 50 of the solids dosing device 52 are running and the multi-way valve 23 is in a switching state (not shown), in which the lines 22 and 25 are connected to each other. The multi-way valve 55 is in the closed position. On the other hand, the multi-way valve 60 is in the open position, so that the funnel 18 and the discharge pump 27 are also connected through the line 59. In this manner, the maximum delivery amount of liquid mixture can be brought out.

In this switching state it is also conceivable as a second possibility to switch in the multi-way valve 23, as shown in the drawing, so that the mixture flows through the mixing vessel 28. The electric motors 32, 33, 34 of the pumps 35, 36, 37 then also run for this.

In the third operating state no solids are to be mixed in from the charging funnel 61, but only the liquid components. In this case, the electric motors 4, 21, 51 of the pumps 1, 20 and the dosing device 53 for the liquid components are running. The multi-way valve 23 connects the delivery line 22 of the pump 20 directly with the suction line 26 of the discharge pump 27. A second switching state is also possible here, in which the multi-valve 23 is switched so that the liquid flowing through the line 22 is conveyed through the mixing vessel 28 to the discharge pump 27. For this, the electric motors 32, 33, 34 of the pumps 35, 36, 37 of the mixing vessel chambers 29, 30, 31 are also switched on.

While certain presently preferred embodiments of the present invention have been described above, it is to be distinctly understood that the invention is not limited thereto and may be otherwise variously practiced within the scope of the following claims.

We claim:

1. A device for the continuous production of a liquid mixture of solids and liquids comprising:

(a) a container having an annular rotation-symmetric space therein with an at least approximately vertical rotation axis, in which a rotational flow is created, said annular space (13) having an overflow edge (14) on an inside wall portion thereof (17), said container having at least one feed line (11,12) therein from which a liquid flow under pressure may be provided tangentially into the annular space (13);

(b) a funnel-shaped collecting basin (18) located below the overflow edge (14);

(c) dosing devices (52, 53) for the solid and liquid components having discharge openings therein located above the overflow edge (14); and (d) a pump (20) having a suction line (19) connected to an outlet provided in the funnel-shaped collecting basin (18), said pump (20) having a delivery line (22) thereof in which a multi-way valve (23) is provided that connects the pump to a mixing vessel (28) in one switching position and connects the delivery line (22) of the pump (20) with a suction line (26) of a discharge pump (27) in another switching position.

2. A device according to claim 1, wherein a delivery line (3) of a pump (1) connected with the at least one feed line (11, 12) for the liquid under pressure is split into at least two branch lines (5, 6) and the delivery streams of said branch lines can be closed off by valves (7, 9) and regulated by flow regulators (8, 10).

3. A device according to claim 1, wherein the mixing vessel (28) provides a number of chambers (29, 30, 31) that are connected with each other in series, and each chamber (29, 30, 31) has a pump (35, 36, 37) associated therewith, each said pump having a suction line thereof (41, 42, 43) located inside of the chamber close to a bottom thereof and each said pump having a delivery line divided into two branch lines, one of said branch lines empties into the subsequent chamber above a preset maximum level and the other of said branch lines is returned into the suction chamber near the bottom thereof, and where one of the branch lines (54) of the delivery line of a pump (37) of the last chamber (31) of the in-series chambers (29, 30, 31) of the mixing vessel (28) is connected with the suction line (26) of the discharge pump (27).

4. A device according to claim 3, wherein a multi-way valve (55) is located in the second branch line (54) of the delivery line of the pulp (37) of the last chamber (31) of the in-series chambers (29, 30, 31) of the mixing vessel (28) and said multi-way valve interrupts the connection of the discharge pump (27) to the suction line (26) in at least one switching position of said multi-way valve (55).

5. A device according to claim 1, wherein an outlet of the funnel-shaped collecting basin (18) is connected through a connection line (59) with a suction line (26) of a discharge pump (27) and a multi-way valve (60) is located in said connection line (59) that interrupts the connection to the suction line (26) of the discharge pump (27) in at least one switching position of said multi-way valve (60).

6. A device according to claim 1, wherein a delivery line (56) of a discharge pump (27) has a multi-way valve (57) that short-circuits the delivery line (56) of the discharge pump (27) with a suction line (26) of said discharge pump (27) in at least one switching position of said multi-way valve (57).

7. A device according to the claims 6, wherein the actuating element of the multi-way valve (57) located in the delivery line (56) of the discharge pump (27) is connected with an electric switching member, by which the electric motors (4, 21, 32, 33, 34) of the pumps (1, 20, 35, 36, 37) with the exception of the discharge pump (27), and the electric motors (50, 51) of the dosing devices (52, 53) of the solid and liquid components are switched into the one switching position.

8. A device according to claim 1, wherein a drive of all of a plurality of pumps (1, 20, 35, 36, 37) with the exception of the discharge pump (27) and the drive of the dosing devices (52, 53) for the solid and liquid components are each an electric motor (4, 21, 32, 33, 34, 50, 51).

9. A device according to claim 8, wherein a flowmeter is located in the feed line (11, 12) to the annular space (13) and its output signal controls the speed of the electric motors (50, 51, 21) of the dosing devices (51, 53) for the solid and liquid components and the pump (20) between the funnel-shaped collecting basin (18) and the chambered mixing vessel (28).

10. A device according to claim 9, wherein lower switches (44, 45, 46) are provided in the chambers (29,

30, 31) of the mixing vessel (28) and they switch on the electric motors (32, 33, 34) of the pumps (35, 36, 37) when a preset minimum liquid level is reached, and that an upper switch (47) common to all the chambers (29, 30, 31) is provided in the first chamber (29) and said upper switch (47) switches off the electric motor (21) of the pump (20) between the funnel-shaped collecting basin (18) and the chambered mixing vessel (28) when the maximum liquid level is exceeded.

11. A device according to claim 8, wherein switches (48, 49) are located in the funnel-shaped collecting vessel (18) with a vertical spacing from each other and they switch the electric motors (4, 50, 51) of the dosing devices in or out as a function of the liquid level.

* * * * *